US008985315B2

(12) United States Patent
Mizutani et al.

(10) Patent No.: US 8,985,315 B2
(45) Date of Patent: Mar. 24, 2015

(54) LOADING MEMBER AND SORTING DEVICE

(75) Inventors: Masaaki Mizutani, Shiojiri (JP); Junichi Ootaka, Ueda (JP)

(73) Assignee: Seiko Epson Corporation, Tokyo (JP)

( * ) Notice: Subject to any disclaimer, the term of this patent is extended or adjusted under 35 U.S.C. 154(b) by 139 days.

(21) Appl. No.: 13/226,949

(22) Filed: Sep. 7, 2011

(65) Prior Publication Data

US 2012/0061210 A1 Mar. 15, 2012

(30) Foreign Application Priority Data

Sep. 13, 2010 (JP) ..... 2010-204027

(51) Int. Cl.
*B65G 47/34* (2006.01)
*B65H 39/10* (2006.01)
*B65H 29/40* (2006.01)

(52) U.S. Cl.
CPC ..... *B65H 39/10* (2013.01); *B65H 29/40* (2013.01); *B65H 2301/435* (2013.01); *B65H 2301/4473* (2013.01); *B65H 2301/4476* (2013.01); *B65H 2404/312* (2013.01); *B65H 2404/655* (2013.01); *B65H 2405/352* (2013.01); *B65H 2801/15* (2013.01)
USPC ..... 198/803.13; 198/867.1

(58) Field of Classification Search
USPC ..... 198/867.1, 803.1, 803.13; 271/292, 271/293, 295, 220
See application file for complete search history.

(56) References Cited

U.S. PATENT DOCUMENTS

| | | | | |
|---|---|---|---|---|
| 1,760,030 | A * | 5/1930 | Alger | 412/19 |
| 5,125,500 | A * | 6/1992 | Cailbault | 198/470.1 |
| 5,715,035 | A * | 2/1998 | Doi et al. | 355/40 |
| 8,091,879 | B2 * | 1/2012 | Boss | 270/52.17 |
| 2005/0093225 | A1 | 5/2005 | Honegger | |

FOREIGN PATENT DOCUMENTS

| | | |
|---|---|---|
| JP | 62-168059 | 10/1987 |
| JP | 1-069237 | 5/1989 |
| JP | 1-140379 | 9/1989 |
| JP | 2009-092804 | 4/2009 |

* cited by examiner

*Primary Examiner* — Gene Crawford
*Assistant Examiner* — Lester Rushin
(74) *Attorney, Agent, or Firm* — Workman Nydegger

(57) ABSTRACT

A loading member includes a receiving section that changes a posture thereof from a receiving posture where a loading material is received to a rising posture where the loading material is supported in a raised state; and a positioning section that is projected from a portion of a base end of the receiving section and then positions a lower end position of the loading material when the posture of the receiving section is changed to the rising posture; wherein the positioning section is provided with a loading assisting member assists the positioning of the loading material in a case of the receiving posture, while the front end of the loading assisting member rotates in a direction to approach a receiving surface of the loading material at the receiving section in a case of changing from the receiving posture to the rising posture.

5 Claims, 8 Drawing Sheets

LOADING MEMBER AND SORTING DEVICE

The entire disclosure of Japanese Patent Application No, 2010-204027, filed Sep. 13, 2010 is expressly incorporated by reference herein.

BACKGROUND

1. Technical Field

The present invention relates to a loading member that can load a loading material for example, printing material or the like, and to a sorting device including the loading member in plurality.

2. Related Art

Generally, as a recording device that performs a recording process on a recording medium, an ink jet type printer is well known in the related art (for example, JP-A-2009-92804). The printer described in JP-A-2009-92804 includes a printer main body section that performs a recording process with respect to each of printing paper sheets per order. In addition, the printer includes a transportation unit that transports the printing paper sheets on which the recording process is completed at the printer main body section to a delivery position and an integrating unit (a sorting device) that sorts and integrates the printing paper sheets (the loading materials) that are discharged to the delivery position by the transportation unit to a plurality of integrating plates (loading members) per order.

In the integrating unit in JP-A-2009-92804, each of the integrating plates is attached at a retaining section that is provided at the outer periphery surface of an endless type integrating belt with substantially the same distance respectively. Thus, each of the integrating plates is on standby in a posture in which a plate surface is horizontal at the delivery position of the printing paper sheets. In addition, when a plurality of printing paper sheets is integrated at the plate surface corresponding to the order, each of the integrating plates moves from the delivery position after the posture thereof is changed so as to rise according to the rotation operation of the integrating belt.

However, as shown in FIG. 8, an integrating plate PT that is disclosed in JP-A-2009-92804 has a planar receiving section 101 that receives the printing paper sheets at a delivery position in a lying state and a positioning section 102 that positions a lower end position of paper sheets P (P1 and P2) integrated on the receiving section 101 in a rising state. The positioning section 102 supports the lower end of the paper sheets P that is in the rising state which is the same as that when the integrating plate PT is raised. The positioning section 102 also has a function as a sidewall restricting the paper sheets P from sticking out from the receiving section 101 when the receiving section 101 receives the paper sheet P.

Although, as shown in FIG. 8A, if the paper sheet P1 that is discharged from the printer main body section is curled in the upper direction, the end (right end in the drawing) of the paper sheet P1 that is lifted up may cover over the positioning section 102 and may stick out from the integrating plate PT. In addition, when the integrating plate PT is raised in a direction (clockwise) as shown in an arrow in FIG. 8A in a state where the paper sheet P1 cover over the positioning section 102, there is a problem in that the paper sheet P1 is scattered and dropped from the integrating plate PT.

Meanwhile, as shown in FIG. 8B, if the paper sheet P2 that is discharged from the printer main body section is curled in the down direction, the center of gravity of the paper P2 is separated from the receiving section 101 when the integrating plate PT is raised. Thus, when the integrating plate PT is raised, there is a concern that the paper sheet P2 is scattered and dropped from the integrating plate PT by the inertial force thereof. Further, these problems are not limited to the sorting device that includes a plurality of loading members such as integrating plates and are common to a loading member that changes the posture thereof to be rising after a loading material is loaded in a lying state.

SUMMARY

An advantage of some aspects of the invention is that a loading member and a sorting device including a plurality of loading members are provided, which are capable of suppressing the dropping of a loading material according to a change of a posture thereof.

According to an aspect of the invention, there is provided a loading member including: a receiving section that changes a posture thereof from a receiving posture where a loading material is received in a laid state to a rising posture where the loading material is supported in a raised state by raising a front end side of the loading material; and a positioning section that is projected from a portion of a base end of the receiving section and then positions a lower end position of the loading material that is loaded on the receiving section when the posture of the receiving section is changed to the rising posture, wherein the positioning section is provided with a loading assisting member which is raised in an up direction from an upper end that is a front end of the positioning section and assists the positioning of the loading material when the posture of the receiving section is the receiving posture, and a front end side of which rotates about a base end side that is the positioning section side as a rotation center in a direction to approach a receiving surface of the loading material at the receiving section when the posture of the receiving section changes from the receiving posture to the rising posture.

According to the configuration, even in a case where end of the loading material that is loaded on the receiving section at the receiving posture is lifted up from the receiving section, the loading material is capable of being reliably positioned by the loading assisting member. In addition, in a case where the posture is changed from the receiving posture to the rising posture, the loading assisting member rotates and then the loading material is pinched between the loading assisting member and the receiving section so that the loading material is capable of being pressed by the loading assisting member. Accordingly, the dropping of the loading material according to the change of the posture from the loading member is capable of being suppressed.

In the loading member of the invention, in a front end section of the loading assisting member, the front end thereof at the receiving posture may be bent in a direction facing the receiving surface of the receiving section.

According to the configuration, the bent front end section of the loading assisting member positions the upper end position of the loading material so that the loading material is capable of suppressing the lifting up thereof over the loading assisting member. Accordingly, in a case where the posture of the receiving section changes from the receiving posture to the rising posture, the loading material is capable of suppressing the dropping thereof over the loading assisting member.

According to another aspect of the invention, there is provided a sorting device including: a plurality of loading members as described above that is arranged in a line along a sorting direction; and a moving mechanism that changes the posture of the receiving section which received the loading material from the receiving posture to the rising posture and moves the loading members to the sorting direction, wherein the sorting device sorts the received loading material by a plurality of the loading members, wherein the loading assisting member contacts the loading members that are arranged so as to be adjacent downstream in the sorting direction so that the front end section rotates in an approaching direction to the receiving surface of the receiving section when the posture of the receiving section changes from the receiving posture to the rising posture.

According to the configuration, the loading assisting member contacts the loading members that are arranged so as to be adjacent downstream in the sorting direction and rotates so that even in a case where spaces are present between the loading members that are arranged so as to be adjacent to each other, the loading material is capable of suppressing the dropping thereof between the spaces.

In the sorting device of the invention, the loading members may receive the loading material that is transported to a transporting direction crossing the sorting direction and then is discharged to the loading members, and the loading assisting member may rotate about a rotation shaft that is extended in the transporting direction as the rotation center and is provided in plurality along the transporting direction.

According to the configuration, the plurality of loading assisting members is arranged so that even in a case where the lengths of the cut paper sheets in the transporting direction of the loading material are different from each other or in a case where the dropping positions of the cut paper sheets in the transporting direction of the loading material are different from, the loading of each of the loading materials is capable of being assisted.

In the sorting device of the invention, the loading assisting member may have a main body section that is extended in the same direction as the positioning section at the receiving posture and a restricting section that contacts the positioning section at the receiving posture so as to restrict the rotation of the main body section.

According to the configuration, the restricting section restricts the rotation of the main body section so that the positioning of the main body section is capable of being performed at the receiving posture.

In the sorting device of the invention, the main body section of the loading assisting member may be positioned having a gap with the receiving section at the rising posture.

According to the configuration, the main body section is positioned having the gap with the receiving section and then is parallel with the receiving section at the rising posture so that the loading assisting member is capable of straightening the posture of the cut paper that is pinched between the receiving section and the main body section.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
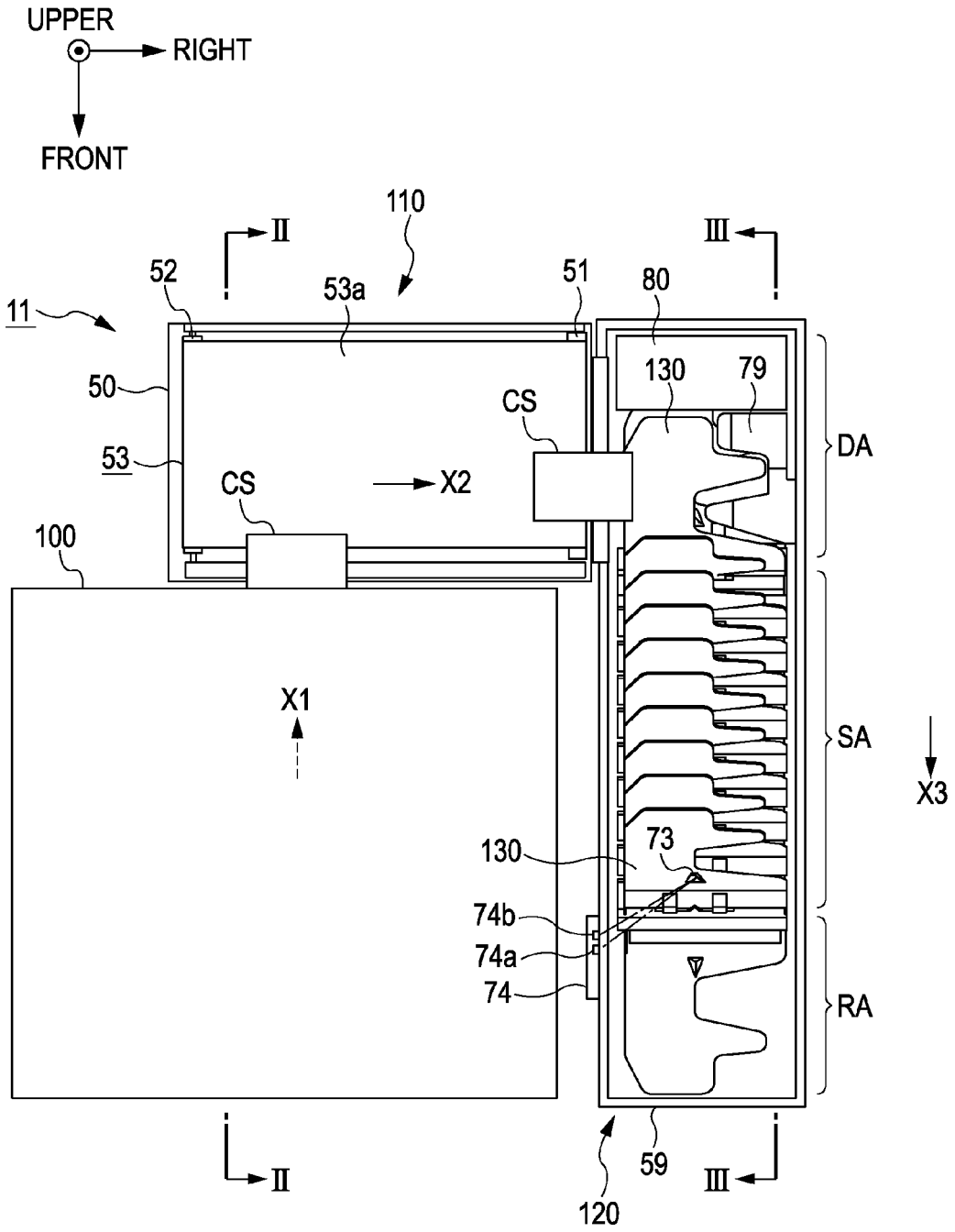
FIG. 1 is a plan view illustrating a configuration of a printer unit including a sorting device as an embodiment of a sorting device according to the invention.

An embodiment, which is specified to a sorting device that is used belonging to an ink jet type printer (sometimes referred to as "printer" below) that is a type of the recording apparatus of the invention will be described. In the below description, when "a front and rear direction", "a right and left direction" and "an up and down direction" are referred to, they illustrate the front and rear direction, the right and left direction and the up and down direction that are shown in arrows in the respective drawings. In addition, in the arrows that show the up direction, the right direction and the front direction in the drawing, that "●" is marked within "○" means an arrow (a drawing where the front end of an arrow is seen from the front thereof) that is directed to the front from the rear of the drawing. That "X" is marked within "○" means an arrow (a drawing where the feathers of an arrow are seen from the rear thereof) that is directed to the rear from the front of the drawing.

As shown in FIG. 1, a printer unit 11 includes a printer 100 that is an example of a recording device, a transportation device 110 and a sorting device 120 as constitutional elements. The printer 100 performs recording (printing) with respect to a sheet ST (see FIG. 2) that is rectangular-shaped paper and cuts a portion of the sheet ST where the recording is performed so that the paper is discharged as cut paper CS that is an example of a loading material.

The transportation device 110 transports the recorded cut paper CS that is discharged from the printer 100 to the sorting device 120. The sorting device 120 discharges the cut paper CS to a delivery area DA that receives the cut paper CS. Further, the sorting device 120 includes a plurality of the trays 130 as an example of a loading member. Each tray 130 is made of translucent synthetic resin. Thus, each tray 130 progressively moves to a delivery area DA so that the sorting device 120 sorts the cut paper CS (the printing material).

Next, the constitution of the printer 100 will be described.

Figure 2:
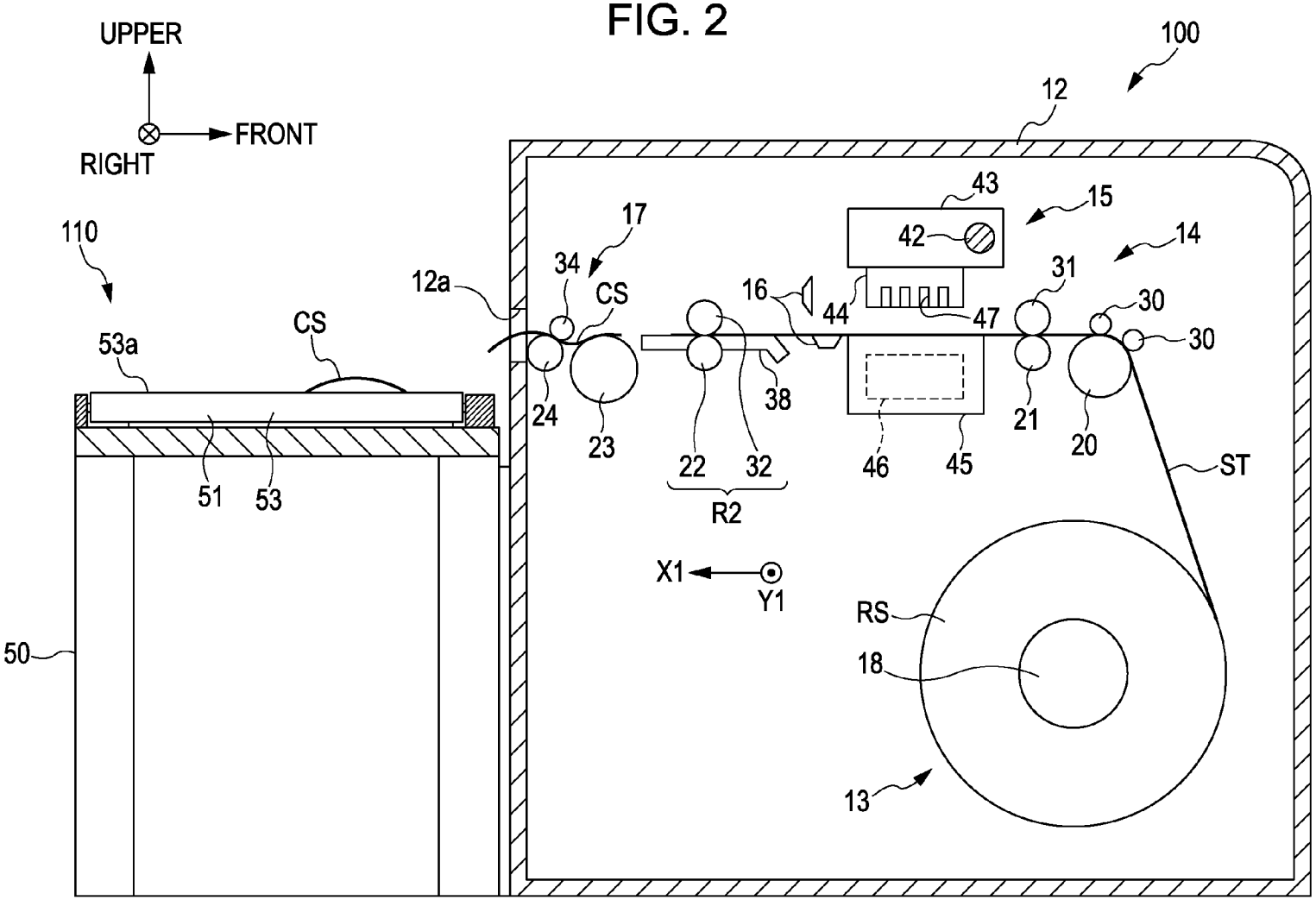
FIG. 2 is a cross-sectional arrow view taken along a cross-sectional line II-II shown in FIG. 1.

As shown in FIG. 2, the printer 100 includes a substantially rectangular-shaped main body case 12 having a paper discharging section 12*a* at an upper portion of a rear wall thereof and a retaining section 13 that retains a sheet ST in a state of a roll body RS that is wound and overlapped in a roll shape at the front and lower portion within the main body case 12. In addition, the printer 100 includes a transportation mechanism 14 that transports the sheet ST along a transporting passage extended to the paper discharging section 12*a* from the retaining section 13 within the main body case 12. A recording section 15 that performs the recording with respect to the sheet ST unwound from a roll body RS and a cutter 16 are provided within the main body case 12. A curl correcting mechanism 17 that forms a portion of the transportation mechanism 14 is provided at a position adjacent to the paper discharging section 12*a* within the main body case 12.

The recording process is performed on the surface of the sheet ST that is transported by the transportation mechanism 14 at the recording section 15. After that, a cutter 16 cuts a portion of the sheet ST on which the printing is performed. Thus, a portion of the front end of the sheet ST that is cut becomes cut paper CS (cut sheets). Further, curl (tendency to be wound) of the cut paper CS is corrected at the curl correcting mechanism 17.

The retaining section 13 includes a rotation shaft 18 that rotatably supports the roll body RS and a rotation motor (not shown) that rotates the rotation shaft 18. Thus, when the rotation shaft 18 rotates counterclockwise in FIG. 2 according to the driving of the rotation motor, the sheet ST is unrolled from the roll body RS.

The transportation mechanism 14 includes a plurality of transporting rollers 20 to 24 which transport the sheet ST from the upstream to the downstream (from the front side to rear side in the embodiment) in the transporting direction X1, and driven rollers 30, 31, 32 and 34 which pinch the sheet ST between each of the transporting rollers 20, 21, 22 and 24. Each of the transporting rollers 20, 21, 22 and 24 and each of the driven rollers 30, 31, 32 and 34 interpose the transporting passage and are arranged in positions facing each other.

Further, in the below description, the transporting roller 22 and the driven roller 32 that are paired with each other are referred to as a transporting roller pair R2. In addition, the transportation mechanism 14 includes a paper transportation motor (not shown) that rotates the transporting rollers 20 to 24 and a transporting passage forming member 38 that is arranged at a position corresponding to the transporting roller pair R2.

The recording section 15 includes a guide shaft 42 that is arranged at the upper side of the transporting passage, a carriage 43 that is supported at the guide shaft 42 and a recording head 44 that is supported by the carriage 43. The recording section 15 also includes a supporting member 45 that is arranged at a position that pinches the transporting passage and faces the recording head 44. The guide shaft 42 is installed in the main case 12 so as to extend along a width direction Y1 (the right and left direction in the embodiment) of the sheet ST, which crosses (orthogonally in the embodiment) the transporting direction X1. Further, the carriage 43 is guided by the guide shaft 42 and reciprocates along the width direction Y1.

A plurality of suction holes (not shown) is formed at the upper surface of the supporting member 45. A suction mechanism 46 that absorbs the sheet ST through the suction holes is accommodated in the supporting member 45. A plurality of nozzles 47 that ejects ink as a liquid is provided at the recording head 44. Thus, ink is ejected from the nozzles 47 of the recording head 44 to the surface (the recording surface that is the upper surface in FIG. 1) of the sheet ST that is supported on the supporting member 45 so that the recording to the sheet ST is performed.

Further, in the printer 100, printing data that is included in one printing job is divided in plural and the printing process is performed for every scanning of the carriage 43 based on each packet of the divided printing data. The portion of the sheet ST where the printing is performed is transported intermittently between intervals of the printing process. In other words, the forming of the band-shaped image in which the width direction Y1 is the longitudinal direction and the transportation of the paper are repeated alternatively at the recording section 15 so that the image is formed based on one printing job.

Further, the cutting of the sheet ST by the cutter 16 is performed in a state where the transportation of the sheet ST by the transportation mechanism 14 is stopped and the upstream thereof is retained with the suction mechanism 46 of the supporting member 45 while the downstream thereof is pinched with the transporting roller pair R2. In the embodiment, when the transportation of the sheet ST stops so as to perform printing, the cutting of the sheet ST is performed. Thus, the transporting rollers 22 to 24 continuously transport the cut paper CS that has been cut without stopping. The cut paper CS is discharged to the transportation device 110 through the paper discharging section 12*a* after the curl correcting mechanism 17 corrects the curl.

The curl correcting mechanism 17 has the transporting rollers 23 and 24, and the driven roller 34 as constitutional elements. When the driven roller 34 pinches the cut paper CS with the transporting roller 24, the driven roller 34 rotates according to the transportation of the cut paper CS and the cut paper CS is bent between the transporting roller 23 and the driven roller 34 so that the curl of the cut paper CS is corrected. Further, the transporting roller 23 also serves as a supporting section that supports the upstream of the bending portion when the cut paper CS is bent.

Next, the constitution of the transportation device 110 will be described.

As shown in FIG. 1, the transportation device 110 transports the cut paper CS that is discharged from the printer 100 to the downstream from the upstream (from the left side to the right side in the embodiment) in the transporting direction X2, and positions on a base die section 50.

The transportation device 110 includes a driving roller 51, a driven roller 52, an endless-type transporting belt 53 that is wound between the driving roller 51 and the driven roller 52, and a transportation motor (not shown) for rotating the driving roller 51. Thus, the transportation motor rotates the driving roller 51 so that the transporting belt 53 rotates (go-around moving).

The upstream side of the transporting belt 53 in the transporting direction X2 is arranged at the lower side of the paper discharging section 12*a* of the printer 100. Further, the downstream side of the transporting belt 53 in the transporting direction X2 is arranged at a position that is adjacent to the delivery area DA of the sorting device 120. Accordingly, when the cut paper CS is loaded on a transporting surface 53*a* (a horizontal surface that is formed on an upper surface) of the transporting belt 53, the cut paper CS is transported to the delivery area DA of the sorting device 120 in the transporting direction X2.

At this time, the transporting belt 53 rotates at a speed such that the cut paper CS is drawn out to near the center portion of the delivery area DA in the transporting direction X2. Thus, when the cut paper CS reaches the downstream end of the transporting surface 53*a* in the transporting direction X2, the cut paper CS is separated from the transporting surface 53*a* and is discharged to the tray 130 that is arranged at the delivery area DA of the sorting device 120.

Next, the constitution of the sorting device 120 will be described.

As shown in FIG. 1, the sorting device 120 includes a box-shaped case 59. The sorting device 120 has the delivery area DA at a position that is rear side in the case 59 and simultaneously has a reversing area RA at a position that is front side in the case 59. Furthermore, the sorting device 120 has a sorting area SA for sorting the cut paper CS between the delivery area DA and the reversing area RA in the front and rear direction of the case 59.

The tray 130 of the sorting device 120 receives a plurality of sheets of cut paper CS that is transported in the transporting direction X2 and discharged to the tray 130 at the delivery area DA of the cut paper CS where the cut paper CS is delivered from the transportation device 110 to the sorting area SA. In addition, the sorting device 120 moves the tray 130 that receives the cut paper CS in a sorting direction X3 (the front direction in the embodiment) of the cut paper CS, which is orthogonal to the transporting direction X2 at the sorting area SA so that the received cut paper CS is sorted. Further, a plurality (9 in the present embodiment) of trays 130 is arranged in a line along the sorting direction X3.

Figure 3:
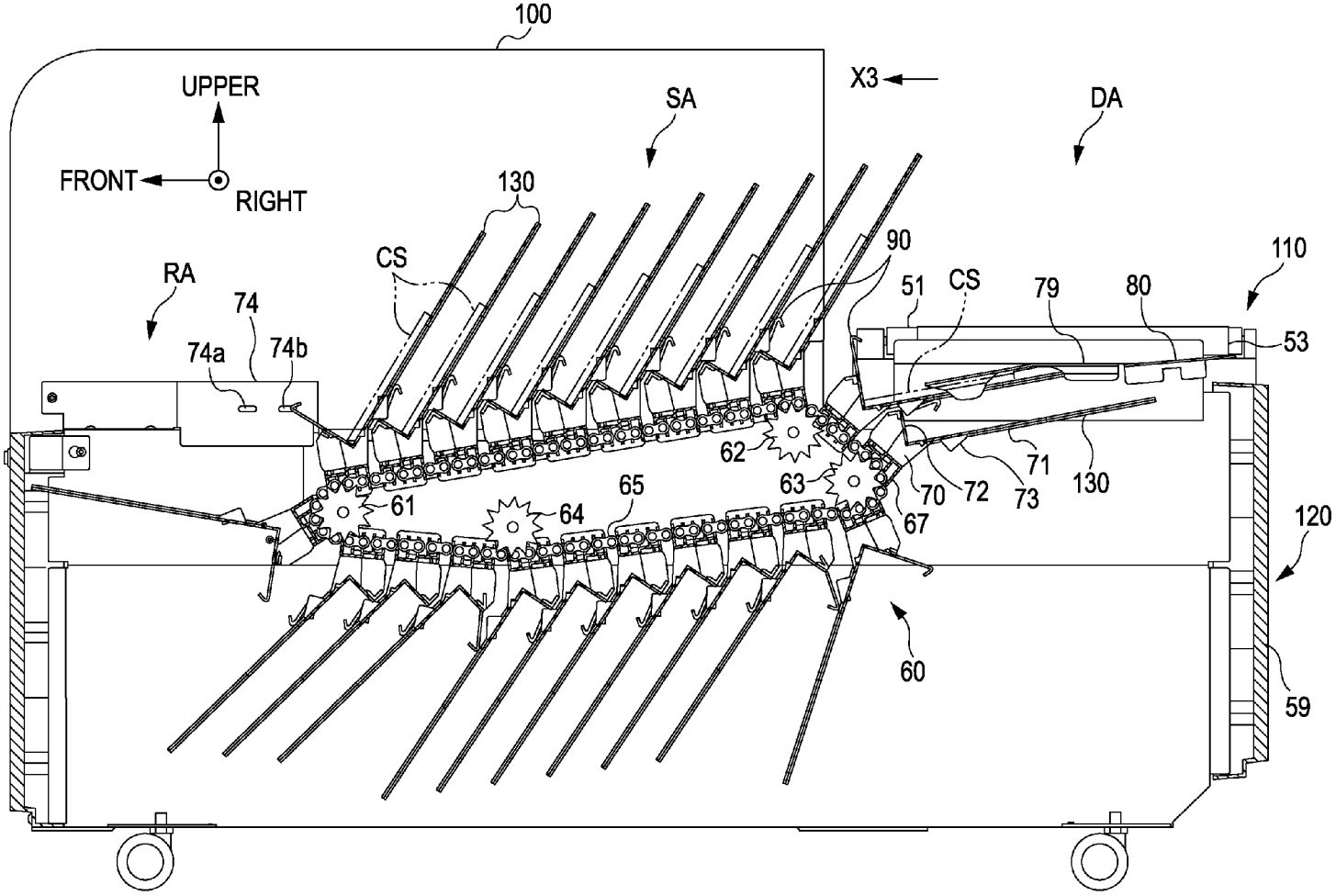
FIG. 3 is a cross-sectional arrow view taken along a cross-sectional line III-III shown in FIG. 1.

As shown in FIG. 3, the sorting device 120 includes a moving mechanism 60 that positions in the case 59. The moving mechanism 60 includes gears 61, 62, 63 and 64, an endless-type chain 65 and a driving motor (not shown) for rotating the gear 61. The gears 61 and 63 are the driving gears and are rotated counterclockwise in FIG. 3 by the driving motor (not shown). In addition, the gear 62 is a driven gear and the gear 64 is a tension gear that is pressed to the lower side by a spring (not shown). Thus, each of the gears 61 to 64 is engaged with respect to the chain 65 in the inside thereof.

The chain 65 is wound on the gears 61, 62, 63 and 64, and is retained in a state where the chain 65 has an appropriate tension by the gear 64. Thus, when the gears 61 and 63 are rotated by the driving motor, the chain 65 go-around moves counterclockwise in FIG. 3 so as to form a constant go-around moving passage.

A plurality of retaining sections 67 for mounting the trays 130 each of which is provided at substantially the same spacing from each other on the chain 65. The tray 130 has a mounting section 70 that is mounted at the retaining section 67, a planar receiving section 71 and a positioning section 72 that is projected from a portion of the base end side of the planar receiving section 71 so as to substantially orthogonal to the receiving section 71 seen from the side view. Thus, one tray 130 is attached to each of the retaining sections 67 of the chain 65 so as to be in a line along the go-around moving passage.

As shown in FIG. 1, a reflecting section 73 is provided adjacent to the center portion of the receiving section 71 of the tray 130 in the transporting direction X2 (the right and left direction). The reflecting section 73 is configured such that a reflecting seal that reflects light is attached to an inclined surface of the right side among three inclined surfaces that form a triangular cone-shaped recess in the rear direction from the receiving section 71.

In addition, a reflective optical sensor 74 having a light source section 74*a* and a light receiving section 74*b* is provided at the left end of the reversing area RA in the case 59. As shown in the two-dot chain line in FIG. 1, the reflective optical sensor 74 emits the light from the light source section 74*a* to the reflecting section 73 of the tray 130 that is arranged at the front most column of the sorting area SA.

If the cut paper CS is not loaded in the tray 130 that is arranged at the front most column of the sorting area SA, the light that is emitted from the light source section 74*a* is reflected by the reflecting section 73 so that the light receiving section 74*b* receives the reflected light. Meanwhile, if the cut paper CS is loaded in the tray 130 that is arranged at the front most column of the sorting area SA, the cut paper CS blocks the light that is emitted from the light source section 74*a* and the light receiving section 74*b* does not receive the reflected light. Accordingly, if the light receiving section 74*b* receives the reflected light at the sorting device 120, the tray 130 moves, until the light receiving section 74*b* does not receive the reflected light. Then, the tray 130 stops.

Since the trays 130 are in a line of nine along the sorting direction X3 at the sorting area SA, the sorting device 120 is capable of sorting the cut paper CS to nine per order. In addition, when the tray 130 that loads the cut paper CS moves to the front most column of the sorting area SA, the tray 130 stops and the cut paper CS is taken out by a user. Thus, when the cut paper CS is taken out from the tray 130 that is positioned at the front most column of the sorting area SA, the movement of the tray 130 restarts in the sorting direction X3. Accordingly, the vacant tray 130 is reversed by the reversing area RA and moves to the delivery area DA again according to the rotation of the chain 65.

Figure 4:
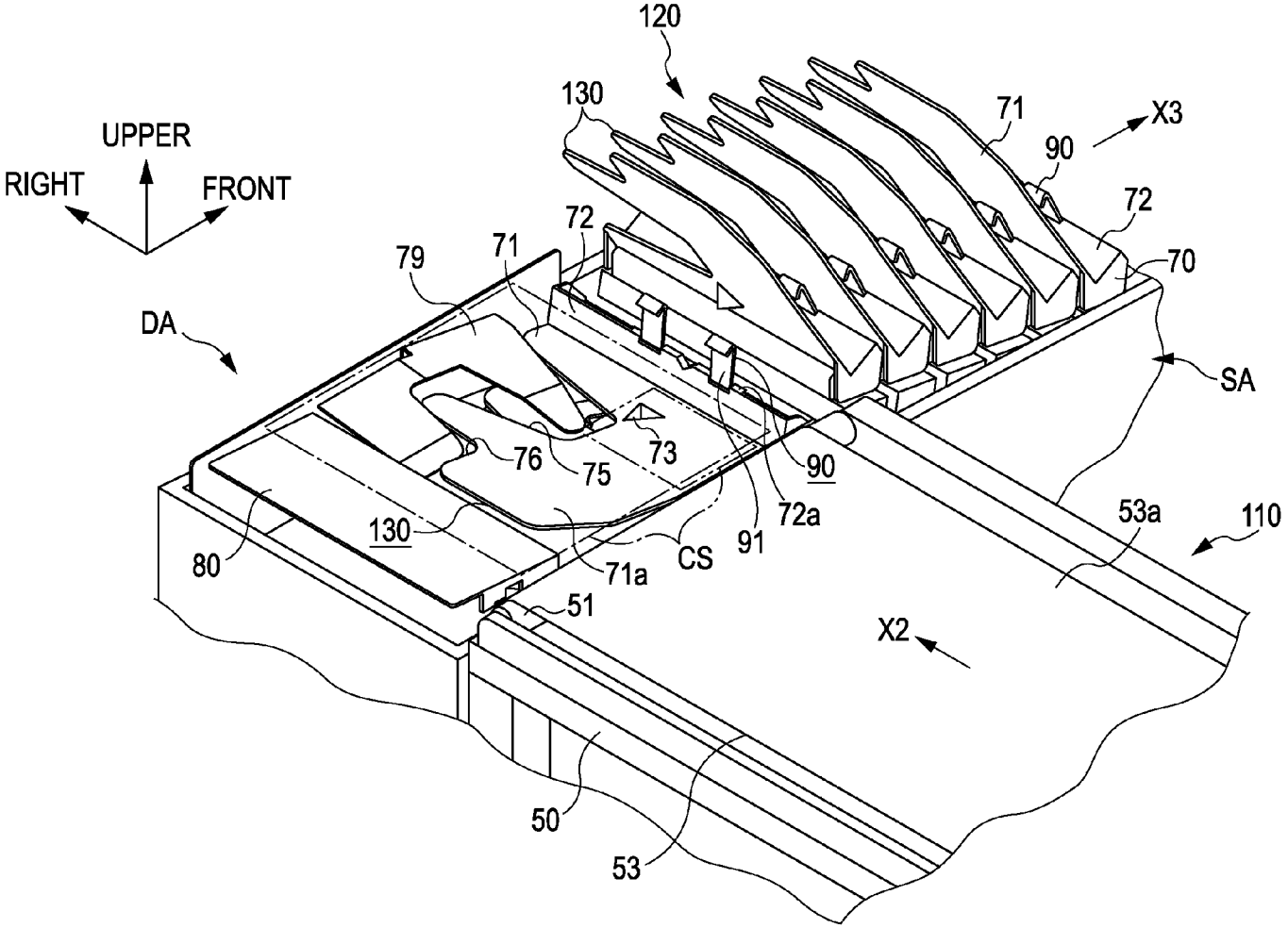
FIG. 4 is a perspective view illustrating a delivery area to the sorting device from a transportation device in the same embodiment.

As shown in FIG. 4, two notch sections 75 and 76 are formed at the right end of the receiving section 71 in the trays 130 so that the taking-out of the cut paper CS by the user is assisted. The sorting device 120 sorts a plurality of sizes of the cut paper CS from the minimum size shown in the two-dot chain line in FIG. 4 to the maximum size shown in the one-dot chain line in FIG. 4. Accordingly, the notch section 75 mainly assists the taking-out of the cut paper CS of a small size while the notch section 76 mainly assists the taking-out of the cut paper CS of a large size. In addition, about fifty cut sheets of paper CS may be loaded on one tray 130. Guide plates 79 and 80 are provided at the delivery area DA in order to stop to receive the cut paper CS that is drawn out to the delivery area DA and guide to the tray 130.

The trays 130 are arranged sequentially at the delivery area DA in a tilting and receiving posture by the moving mechanism 60 so that the receiving section 71 is slightly lowered from the upstream to the downstream in the sorting direction X3. Thus, the tray 130 receives the cut paper CS in a state where the cut paper CS is laid on the receiving surface 71*a* that is the upper surface thereof in a receiving posture. In addition, the positioning section 72 of the trays 130 is provided at an end of downstream of the receiving section 71 in the sorting direction X3. Thus, the cut paper CS that is loaded on the receiving section 71 of the tray 130 is moved by its own weight to the downstream in the sorting direction X3. The positioning section 72 substantially performs the positioning in the sorting direction X3 and the positioning of the lower end position in the sorting direction X3.

Each of the trays 130 that receives the cut paper CS at the delivery area DA sequentially changes the posture to rising from the receiving posture in a state where the cut paper CS is loaded while it moves to the sorting area SA from the delivery area DA according to the driving of the moving mechanism 60. At this time, the receiving section 71 of the tray 130 changes the posture thereof from the receiving posture to the rising posture where the front end thereof rises so as to support the cut paper CS in a rising state.

Further, the positioning section 72 of the tray 130 positions the lower end position of the cut paper CS that is loaded on the receiving section 71 when the posture of the receiving section 71 changes to the rising posture. Thus, the plurality of trays 130 (nine in the embodiment) that is positioned upstream of the chain 65 at the sorting area SA moves in the sorting direction X3 in a state where the receiving sections 71 are slightly tilted so as to be parallel to each other. Further, when the receiving section 71 of the tray 130 has a raised posture, the positioning section 72 is positioned at the lower side of the receiving section 71 so that the lower end of the cut paper CS is supported at the positioning section 72 in a state where the lower surface thereof is leaned and caught at the receiving section 71 as shown in two-dot chain line if FIG. 3.

Figure 6A:
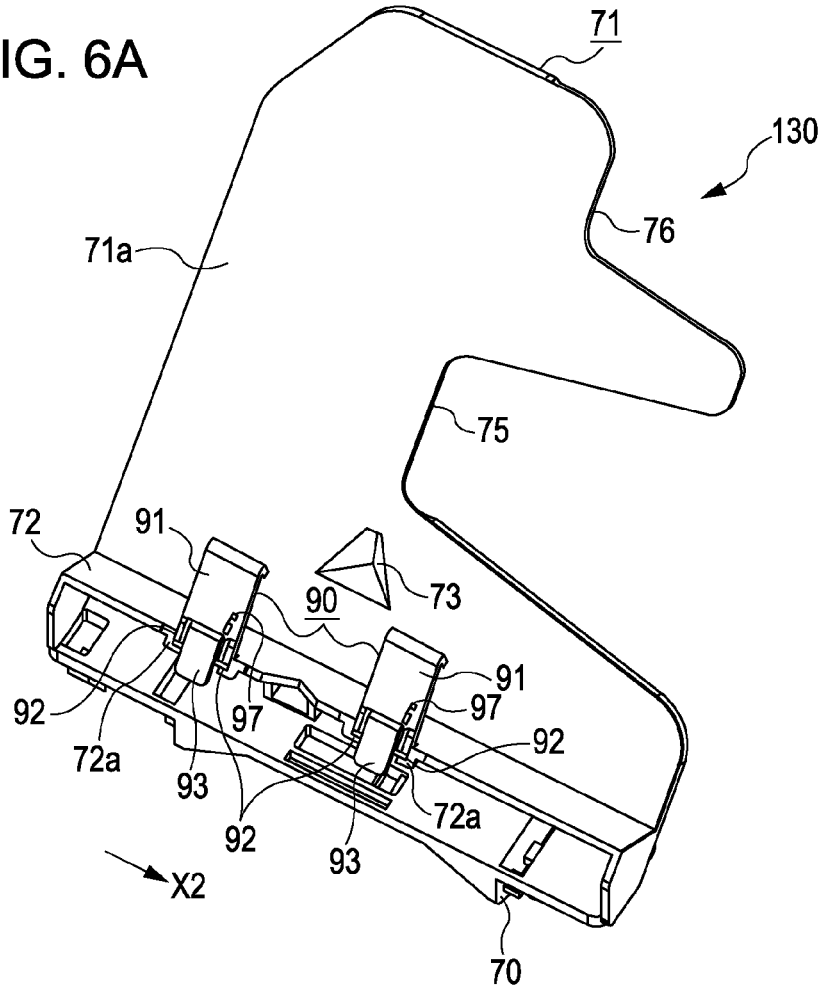
FIG. 6A is a perspective view illustrating a configuration of the loading member at a rising posture of an embodiment according to the invention.
Figure 7B:
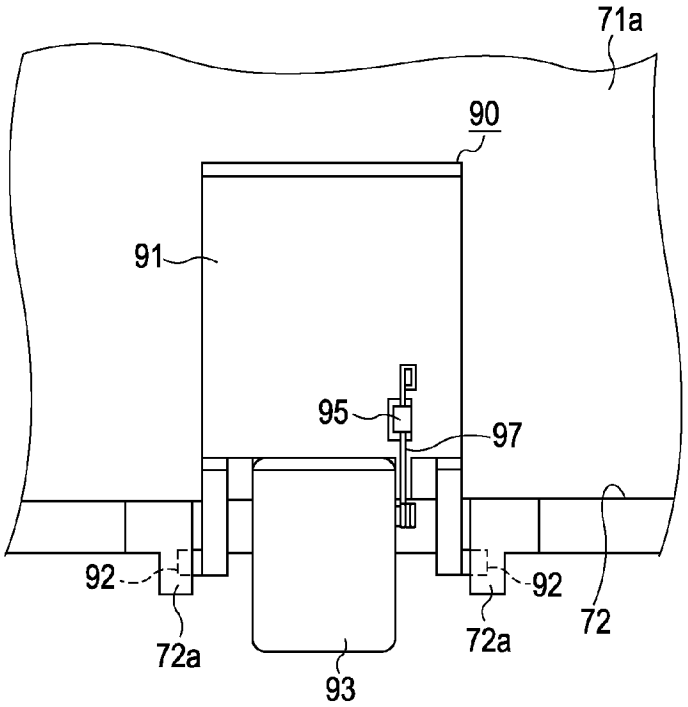
FIG. 7B is a top plan view illustrating a configuration of the loading assisting member at the rising posture of the same embodiment.

Loading assisting members 90 are attached to the positioning section 72 of each of the trays 130. A plurality (two in the embodiment) of the loading assisting members 90 is provided at each of the trays 130 along the transporting direction X2. Each of the loading assisting members 90 has a main body section 91 that is extended in the same direction as the positioning section 72 at the receiving posture, a rotation shaft 92 (see FIGS. 7A and 7B) that is rotatably supported by the supporting section 72*a* provided at the front end section of the positioning section 72 and a restricting section 93 (see FIG. 6A) that is extended from the main body section 91.

Figure 5A:
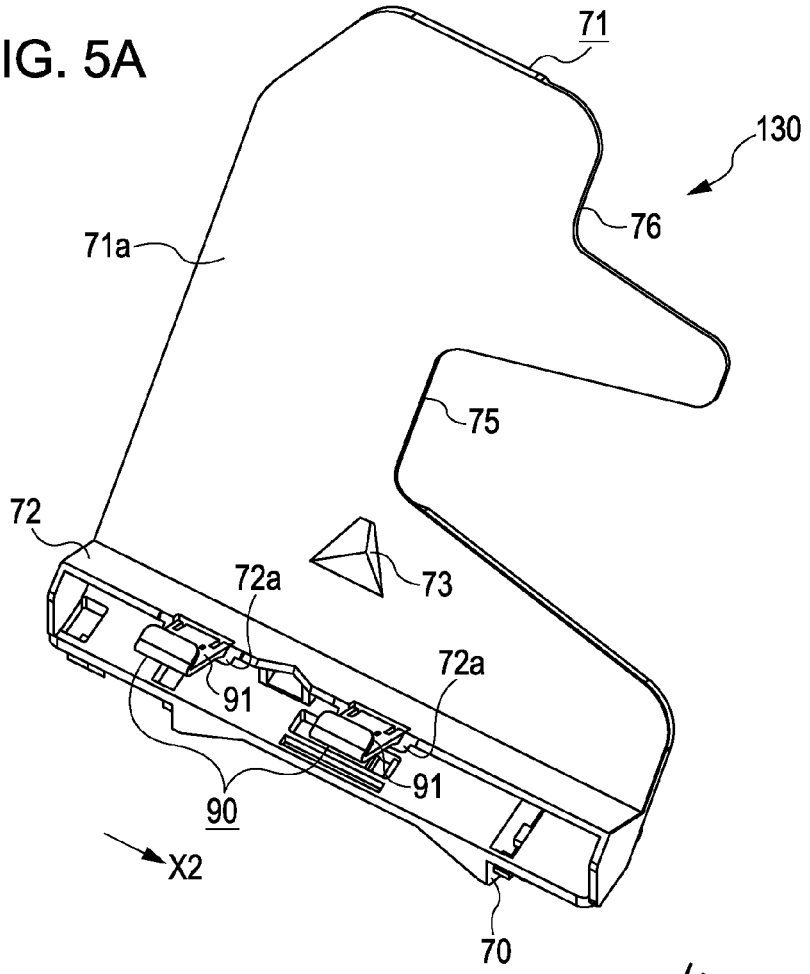
FIG. 5A is a perspective view illustrating a configuration of a loading member at a receiving posture of an embodiment according to the invention.
Figure 5B:
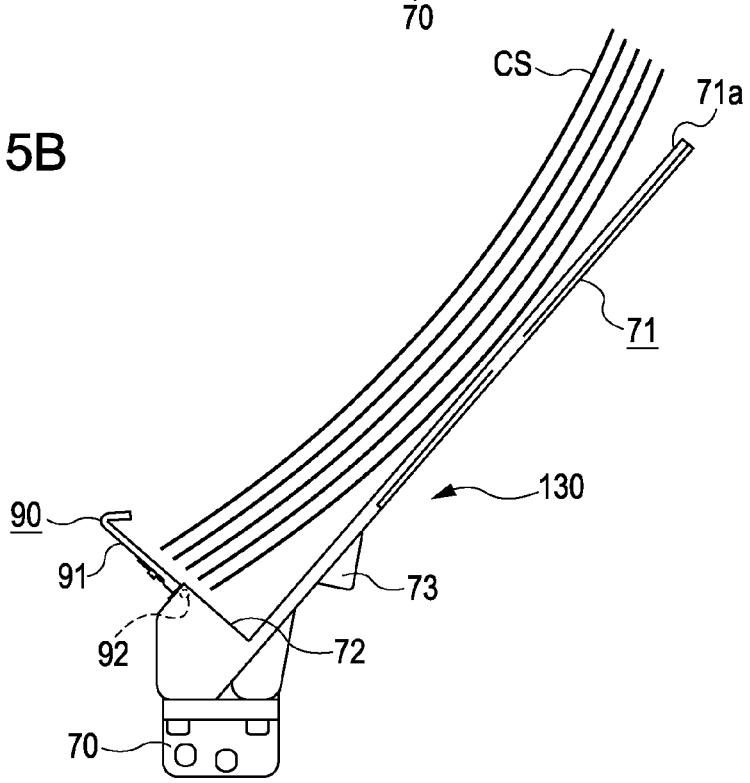
FIG. 5B is a side view describing effects of the same loading member at the receiving posture.

As shown in FIGS. 5A and 5B, the front end section of the main body section 91 in the loading assisting member 90 is bent to a direction facing the receiving surface 71*a* of the receiving section 71 in the receiving posture. In addition, as shown in FIG. 6, the restricting section 93 is extended to the positioning section 72 side from the main body section 91 and the rotation shafts 92 are provided at both sides of the restricting section 93 in the transporting direction X2.

Figure 7A:
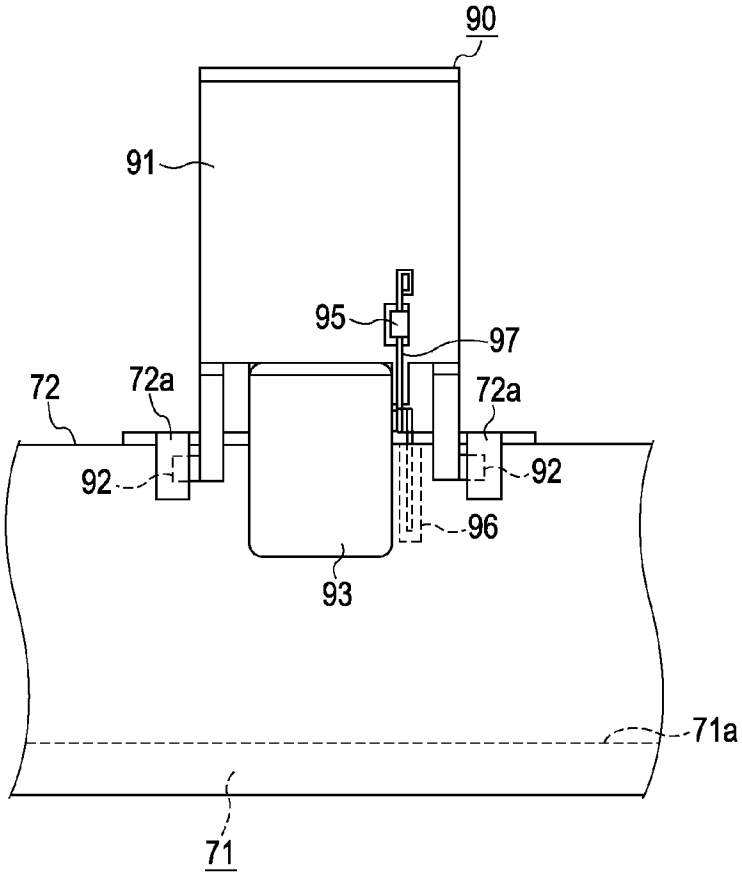
FIG. 7A is a bottom plan view illustrating a configuration of a loading assisting member at the receiving posture in the loading member of the same embodiment.
Figure 8A:
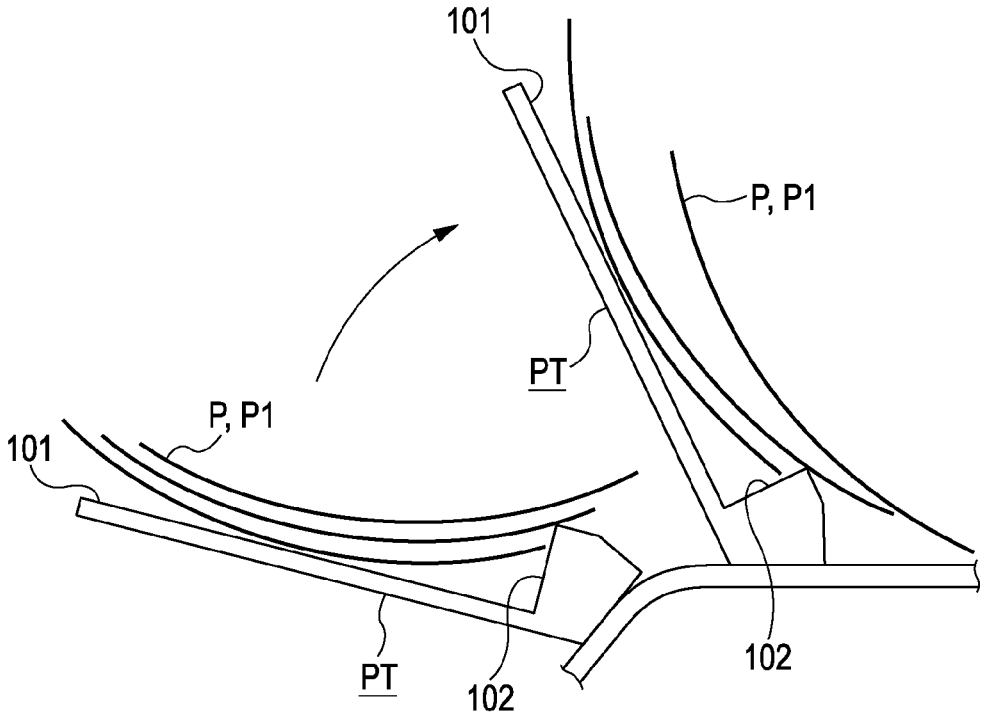
FIG. 8A is a side view schematically illustrating an integrating plate that is included in an integrating unit of a related art.
Figure 8B:
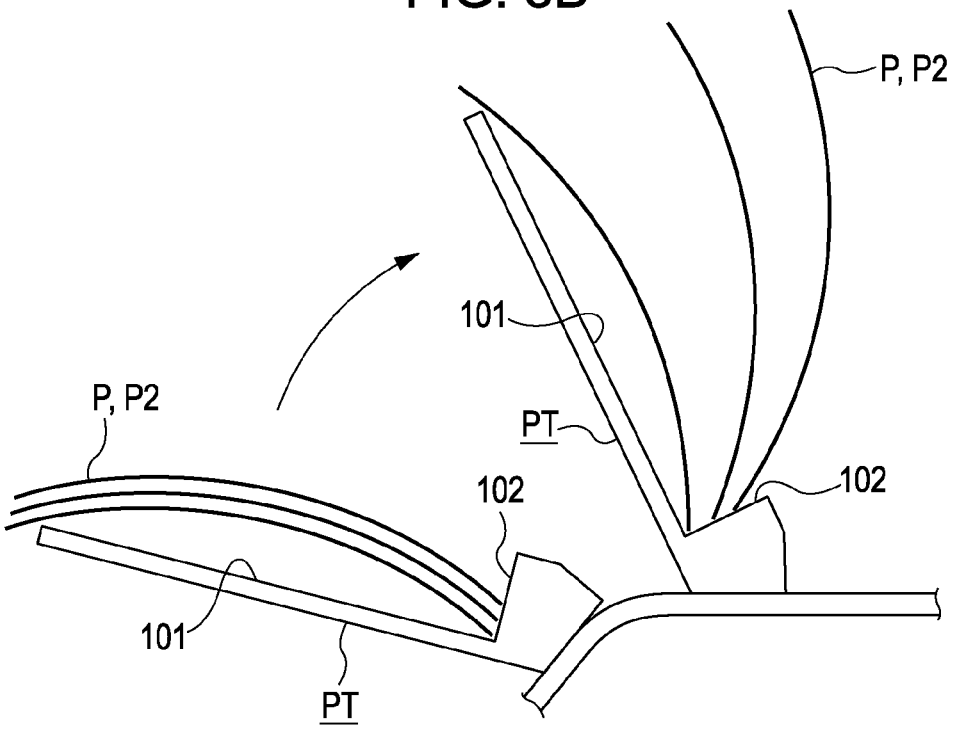
FIG. 8B is a side view schematically illustrating an integrating plate that is included in an integrating unit of a related art.

As shown in FIG. 7A, both rotation shafts 92 are extended in a direction that is separated from the restricting section 93 along the transporting direction X2 respectively. Engaging sections 95 and 96 are provided at the main body section 91 of the loading assisting member 90 and the positioning section 72 of the trays 130 respectively. In addition, a torsion coil spring 97 is provided between the loading assisting member 90 and the positioning section 72 such that both ends thereof are engaged in the engaging sections 95 and 96 respectively. In addition, the coil portion of the torsion coil spring 97 is arranged between the restricting section 93 and one side of the rotation shafts 92 at the loading assisting member 90.

The loading assisting member 90 is arranged at the extended position as shown in FIGS. 5A, 5B and 7A by a pressing force of the torsion coil spring 97 at the receiving posture. At this time, the restricting section 93 contacts a lower surface of the positioning section 72 at the receiving posture so that the rotation of the main body section 91 is restricted.

Further, when the posture of the receiving section 71 is changed from the receiving posture to the rising posture, the loading assisting member 90 contacts the trays 130 that are arranged so as to be adjacent to the downstream in the sorting direction X3 so that the loading assisting member 90 rotates in a direction in which the front end of the main body section 91 approaches the receiving surface 71*a* of the receiving section 71 about the rotation shafts 92 as the rotation center. Thus, the loading assisting member 90 rotates about 90 degrees in clockwise in FIG. 5B until the posture of the receiving section 71 changes to the rising posture. Accordingly, the loading assisting member 90 is arranged at the receiving position shown in FIGS. 6A, 6B and 7B at the rising posture. At this time, the main body section 91 of the loading assisting member 90 is parallel with the receiving section 71.

Next, effects of the trays 130 and the sorting device 120 will be described.

The curl of the cut paper CS is corrected by the curl correcting mechanism 17 of the printer 100, however since the strength of the curl is different according to whether the cut paper CS is wound at the inner periphery side or the outer periphery side of the roll body RS, the curl may remain after the correction.

For example, the curl remains in the cut paper CS having a strong curl before the correction, that is wound at the inner periphery side of the roll body RS as the curl is not corrected by the curl correcting mechanism 17. Thus, as shown in FIG. 2, the cut paper CS is loaded on the trays 130 in a state where the cut paper CS is bent in the down direction. Meanwhile, the cut paper CS having a weak curl before the correction that is wound at the outer periphery side of the roll body RS is curled in the reverse direction by the curl correcting mechanism 17. Thus, as shown in FIG. 5B, the cut paper CS is loaded on the trays 130 in a state in which the cut paper CS is bent in the up direction.

Even though the cut paper CS is loaded on the receiving section 71 in a state where the cut paper CS is curled in the up direction, the loading assisting member 90 is in a rising state from the upper end of the positioning section 72 so that the trays 130 assist the positioning of the cut paper CS as shown in FIG. 5B. In addition, if the positioning section 72 is long corresponding to the lifting up of the cut paper CS, when the receiving section 71 is the rising posture, the gap between the positioning section 72 and the receiving section 71 that is arranged so as to be adjacent to the positioning section 72 is excessively vacant so that the sorting device 120 becomes large. On the contrary, in the trays 130, if the posture of the receiving section 71 is changed from the receiving posture to the rising posture, the front end side of the loading assisting member 90 rotates in the approaching direction to the receiving surface 71*a* of the receiving section 71 about the base end side that is the positioning section 72 side as the center of the rotation. Accordingly, in the sorting area SA, the loading assisting member 90 is bent to the receiving position so that the space may not be excessively occupied.

In addition, when the receiving section 71 of the tray 130 changes the posture thereof from the receiving posture to the rising posture, a space is vacant between the receiving section 71 and the tray 130 that is positioned downstream in the sorting direction X3. Thus, at this time, if the receiving section 71 changes the posture thereof and then the cut paper CS is spilt and dropped from the tray 130, there is a concern that the cut paper CS is dropped and pinched in the space between the trays 130 that are arranged adjacent to each other. On this point, the loading assisting member 90 that is provided at the trays 130 rotates from the extending position to the receiving position according to the posture change of the receiving section 71 so that the dropping of the cut paper CS to the space between the receiving section 71 and the trays 130 that are provided downstream in the sorting direction X3 is capable of being suppressed.

Figure 6B:
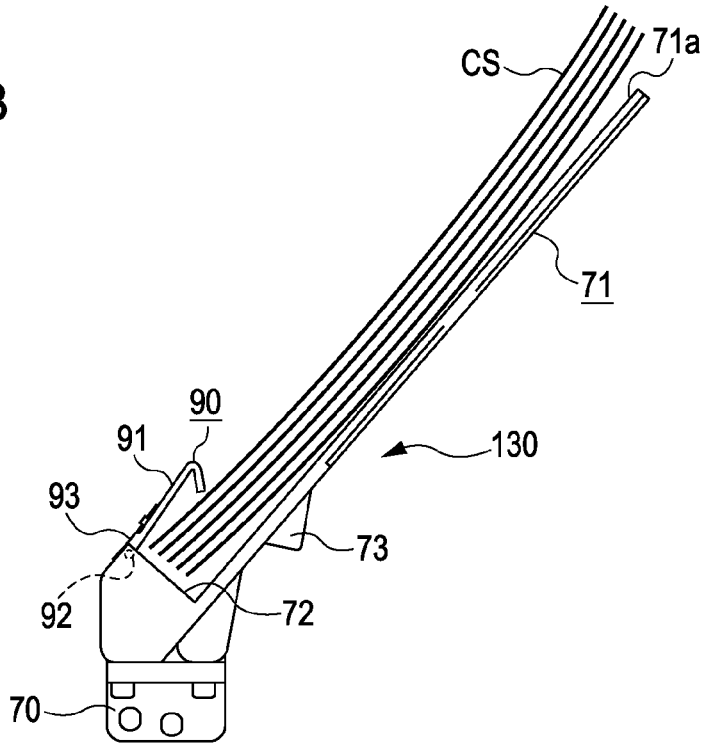
FIG. 6B is a side view describing effects of the same loading member at the rising posture.

Furthermore, the main body section 91 of the loading assisting member 90 is parallel with the receiving section 71 at the receiving position so that as shown in FIG. 6B, the curl of the cut paper CS that is loaded on the receiving section 71 is pressed and the posture thereof is straightened. Accordingly, even in a case where a plurality of the cut paper CS is loaded on one tray 130, the variation of each of the cut paper CS is capable of being suppressed.

According to the above-described embodiments, advantages can be obtained as described below.

(1) Even in a case where the end of the cut paper CS that is loaded on the receiving section 71 at the receiving posture is lifted up from the receiving section 71, the positioning of the cut paper CS is capable of being performed reliably by the loading assisting member 90. Further, when the posture of the receiving section 71 changes from the receiving posture to the rising posture, the loading assisting member 90 rotates and then the cut paper CS is pinched between the loading assisting member 90 and the receiving section 71 so that the cut paper CS is capable of being pressed by the loading assisting member 90. Accordingly, the dropping of the cut paper CS from the trays 130 according to the posture change of the receiving section 71 is capable of being suppressed.

(2) The bent front end of the loading assisting member 90 positions the upper end of the cut paper CS so that the lifting up of the cut paper CS over the loading assisting member 90 is capable of being suppressed. Accordingly, when the posture of the receiving section 71 changes from the receiving posture to the rising posture, the cut paper CS is capable of suppressing the spilling and dropping over the loading assisting member 90.

(3) The loading assisting member 90 contacts the trays 130 that are arranged so as to be adjacent to the downstream in the sorting direction X3 while it rotates so that even in a case where a space is present between the trays 130 adjacent to each other, the dropping of the cut paper CS in the space is capable of being suppressed.

(4) The plurality of loading assisting members 90 are arranged so that even a case where the lengths of the cut paper CS in the transporting direction X2 are different from each other or a case where the dropping positions of the cut paper CS in the transporting direction X2 are different from each other, the loading of each of the cut papers CS is capable of being assisted.

(5) The restricting section 93 restricts the rotation of the main body section 91 so that the positioning of the main body section 91 is capable of being performed at the receiving posture.

(6) The main body section 91 is parallel with the receiving section 71 at the rising posture so that the loading assisting member 90 is capable of straightening the posture of the cut paper CS that is pinched between the receiving section 71 and the main body section 91.

In addition, the above-described embodiments may be changed as described below.

A convex section having spherical shape or semi-spherical shape is provided at the front end of the loading assisting member 90 that is arranged in the trays 130 so that the position of the upper end of the cut paper CS may be positioned or the cut paper CS may be pressed by the convex section. According to the configuration, a sliding load of the loading assisting member 90 with respect to the cut paper CS is capable of being suppressed.

The loading assisting member 90 may not include the restricting section 93.

The loading assisting member 90 does not include the rotation shafts 92 but is resiliently deformed so as to bend near the base end that is attached to the positioning section 72 of the trays 130 so that the front end thereof may be rotated.

Only one loading assisting member 90 having a length corresponding to the cut paper CS in the transporting direction X2 may be provided or three or more may be provided along the transporting direction X2 so as to correspond to the end sections of the cut sheets of paper CS that are different in the size in the transporting direction X2.

The transporting direction X2 and the sorting direction X3 may accord to each other. In other words, the cut paper CS may be discharged to the positioning sections 72 of the trays 130 that are downstream in the sorting direction X3 from the guide plate 80 that is upstream in the sorting direction X3 rather than the delivery area DA.

The number of trays 130 that are provided at the sorting device 120 or the number of trays 130 that are arranged at the sorting area SA may be changed arbitrarily.

At the delivery area DA, the receiving sections 71 of the trays 130 may receive the cut paper CS in the receiving posture that is horizontal.

The loading member is not limited to the shape in which the receiving section 71 and the positioning section 72 cross in L-shaped seen from the side view as described in the above-described embodiment. For example, the loading member may be a box shape having a bottom and sidewalls that are raised at the periphery of the planar receiving section. Otherwise, the positioning section may be projected comb-shapedly from the receiving section.

The printer 100 may perform the printing not only on the cut paper CS that is cut from long sheet ST but also on the cut paper CS that is cut beforehand. Further, the curl of the cut paper CS is not limited to one that is generated by retaining in a state where long sheet is rolled in roll-shaped. Further, even though the cut paper CS is cut beforehand, the curl may be generated by a surface processing such as printing and coating or a humidification or heating.

The printer 100 may be a liquid ejection apparatus including a liquid ejecting head that ejects or discharges liquid droplets of micro quantity of liquid other than ink. Further, the liquid droplets refer to a state of liquid that is ejected from the liquid ejection apparatus and also includes droplets that draw a trailing edge in a granule shape, a dripping shape and a string shape. Further, liquid described here may be any material that can be ejected from the liquid ejection apparatus. For example, the material may be in a state of a liquid phase and the material includes not only a liquid material having a high viscosity or a low viscosity, but also a flow phase material such as sol, gel water, inorganic solvent, organic solvent, solution, liquid phase resin, liquid phase metal (metal fusing liquid) or the like. Additionally, the material includes not only liquid as a material state but also a material in which particles of a functional material that is formed from a solid material, such as a pigment, metal particles or the like, are dissolved, dispersed or mixed in the solvent. Representative examples of the liquid are ink, liquid crystal or the like that are described in the above embodiments, liquid crystal and the like that are described in the embodiments. Here, ink includes general water ink, oil ink, and other ink, which includes various liquid compositions such as gel ink, hot melt ink or the like. As a specific example of the liquid ejection apparatus, there are, for example a liquid ejection apparatus that ejects liquid including materials for an electrode material, color material or the like as a dispersing or dissolved phase and a printing apparatus that is used to manufacture a liquid crystal display, an EL (electroluminescence) display, a surface emitting display and a color filter.

In the above-described embodiments, description has been given regarding the printer that employs the ink jet type as the recording type; however, the printer may be changed to a printer having an arbitrary recording type such as a dot impact type, an electronic transferring type, thermal transferring type or the like. Further, the printer is not limited to the serial printer and may be a line printer and a page printer.

The recording apparatus is not limited to the printer and may be a facsimile apparatus, a copying apparatus or a multifunction apparatus that includes a plurality of functions or the like. In addition, the recording apparatus may be a label printer, a bar code printer, and a note issuing apparatus or the like.

The loading material is not limited to paper and may be any material such as metal, plastic film, cloth, magnetic tape, rubber or the like. Further, the loading material is not limited to cut paper and may be a sack that includes air or the like inside thereof and expanded, a brochure where a plurality of cut paper is filed, a label where a separating paper is attached or the like.

The sorting device is not limited to one that is used attached to the recording apparatus. For example, the sorting device may be a device that sorts arbitrarily a loading material where an attaching process of the seal, a transferring process of the sheet, a staple (filing) process, embossing process, bending and overlapping process or the like are performed. Further, the trays 130 are not limited to the sorting device and may be employed to a device where a loading material in which above-described processes are performed is received, the loading material is in a rising state and the position of the lower end thereof is straightened and then the loading material is transported to the next process (for example, a packing process, an inspection process or the like) in a state where the loading material is raised. In addition, in a case where only one tray 130 is prepared or in a case where the trays 130 are arranged at positions that do not contact the adjacent trays 130 to each other, the loading assisting member 90 contacts a wall surface of the machine or a projecting section that is provided at the machine so that the loading assisting member 90 is capable of being rotated.

What is claimed is:

1. A loading member comprising:

a receiving section that changes a posture thereof from a receiving posture where a loading material is received in a laid state to a rising posture where the loading material is supported in a raised state by raising a front end side of the loading material; and a positioning section that is projected from a portion of a base end of the receiving section and then positions a lower end position of the loading material that is loaded on the receiving section when the posture of the receiving section is changed to the rising posture, a loading assisting member that is rotatably provided in the positioning section, wherein the loading assisting member is raised in an up direction from an upper end that is the front end of the positioning section and assists the positioning of the loading material when the posture of the receiving section is the receiving posture, and a front end side of which rotates about a base end side that is the positioning section side as a rotation center in a direction to approach a receiving surface of the loading material at the receiving section when the posture of the receiving section changes from the receiving posture to the rising posture, wherein the loading assisting member extends from the front end of the positioning section in the same direction that the positioning section extends from the base end of the receiving section when the receiving section is in the receiving posture, wherein in a front end section of the loading assisting member, the front end thereof at the receiving posture is bent in a direction facing the receiving surface of the receiving section that receives the loading material and the loading assisting member and the positioning section both extend with substantially the same angle with respect to the receiving section to thereby form a substantially straight line when the loading assisting member is extended in the receiving posture.

2. A sorting device comprising:

a plurality of loading members as described in claim 1 that is arranged in a line along a sorting direction; and a moving mechanism that changes the posture of the receiving section which received the loading material from the receiving posture to the rising posture and moves the loading members to the sorting direction, wherein the sorting device sorts the received loading material by a plurality of the loading members, wherein the loading assisting member contacts the loading members that are arranged so as to be adjacent downstream in the sorting direction so that the front end section rotates in an approaching direction to the receiving surface of the receiving section when the posture of the receiving section changes from the receiving posture to the rising posture.

3. The sorting device according to claim 2, wherein the loading members receive the loading material that is transported to a transporting direction crossing the sorting direction and then is discharged to the loading members, and the loading assisting member rotates about a rotation shaft that is extended in the transporting direction as the rotation center and is provided in plurality along the transporting direction.

4. The sorting device according to claim 2, wherein the loading assisting member has a main body section that is extended in the same direction as the positioning section at the receiving posture and a restricting section that contacts the positioning section at the receiving posture so as to restrict the rotation of the main body section.

5. The sorting device according to claim 4, wherein the main body section of the loading assisting member is positioned having a gap with the receiving section at the rising posture.

* * * * *